United States Patent [19]

Sonneman

[11] Patent Number: 5,034,865

[45] Date of Patent: Jul. 23, 1991

[54] HALOGEN LAMP ASSEMBLY

[75] Inventor: Robert A. Sonneman, New York, N.Y.

[73] Assignee: Sonneman Design Group, Inc., Long Island City, N.Y.

[21] Appl. No.: 350,100

[22] Filed: May 10, 1989

[51] Int. Cl.[5] ..... F21S 1/12

[52] U.S. Cl. ..... 362/226; 362/410

[58] Field of Search ..... 362/331, 401, 410, 413, 362/418, 419, 422, 426, 427, 226

[56] References Cited

U.S. PATENT DOCUMENTS

| | | | |
|---|---|---|---|
| 3,748,463 | 7/1973 | Trassinelli | 362/413 |
| 3,780,773 | 2/1984 | Sapper | 362/426 |
| 4,525,773 | 6/1985 | Hesse et al. | 362/427 |
| 4,772,991 | 9/1988 | Wood | 362/427 |
| 4,802,074 | 1/1989 | Puschkarski | 362/419 |
| 4,837,667 | 6/1989 | Grau | 362/407 |
| 4,858,092 | 8/1989 | Lu | 362/413 |
| 4,875,648 | 10/1989 | Guarnori | 362/418 |

*Primary Examiner*—Ira S. Lazarus
*Assistant Examiner*—Richard R. Cole
*Attorney, Agent, or Firm*—Gottlieb, Rackman & Reisman

[57] ABSTRACT

A halogen lamp assembly having a number of independently formed component parts is provided. The lamp assembly of the invention includes a base which rests on a table or desk surface and a powder connector assembly selectively retained in part by the base. The power connector assembly includes a receptacle assembly mounted in the base for receiving an electrically conductive arm assembly and a wire assembly coupled to the receptacle assembly which may be plugged into a conventional electrical outlet. The lamp assembly further includes a bulb housing assembly for retaining a conventional halogen bulb that is selectively connectably to the arm assembly at the other end thereof.

16 Claims, 4 Drawing Sheets

FIG.7
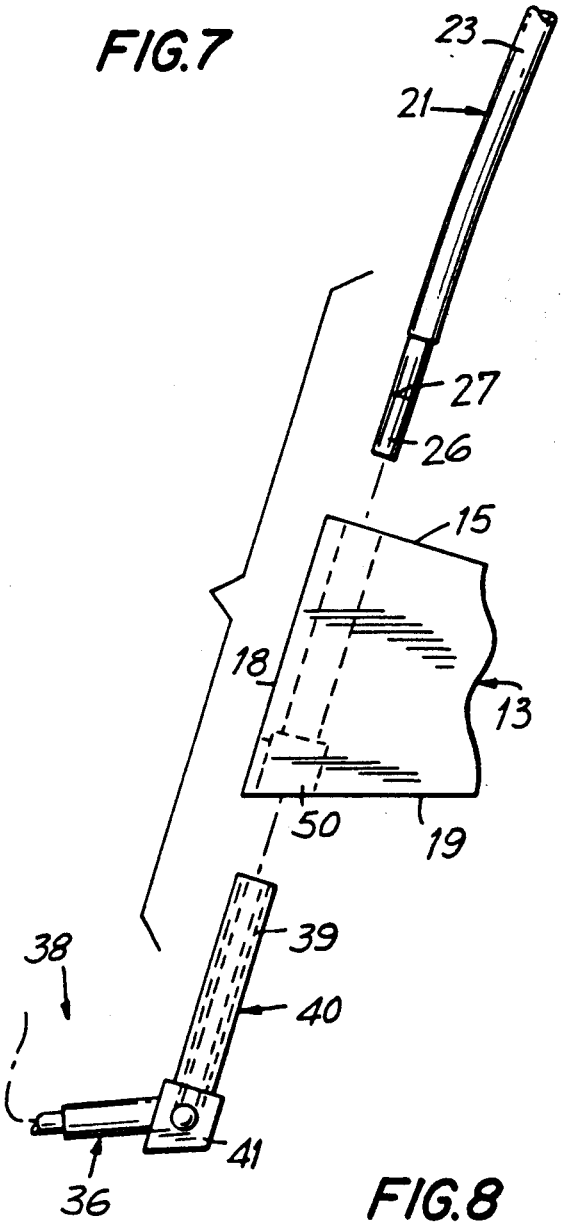
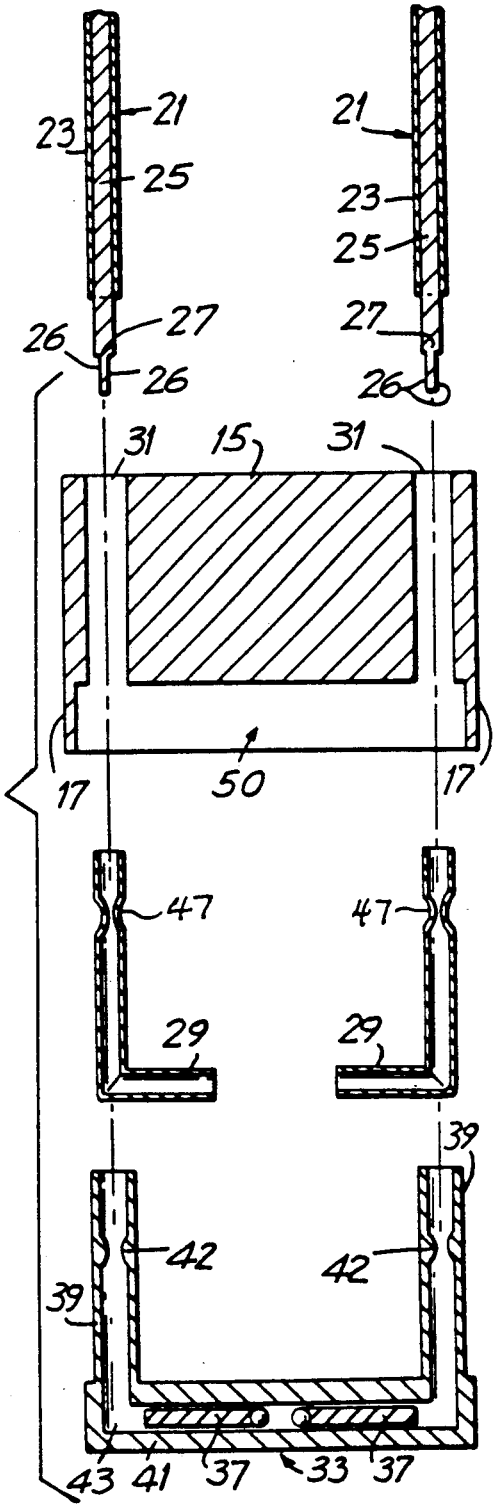
FIG.8

HALOGEN LAMP ASSEMBLY

BACKGROUND OF THE INVENTION

This invention relates to a halogen lamp assembly, and more particularly to a lamp assembly having a number of independently formed component parts that can be constructed at different locations and then be assembled by the manufacturer.

Halogen lamp assemblies are well known in the art and are popular in offices and homes for use on a desk or table top. Most halogen lamps are rather expensive, due to the complexity of the manufacturing stage and the fact that each component or element of the lamp assembly must be carefully connected to the next element by highly skilled personnel whom the manufacturer hires.

Accordingly, it would be desirable provide a lamp assembly whose parts may be constructed elsewhere, and which the component parts may be connected together easily by the manufacturer or wholesaler.

SUMMARY OF THE INVENTION

Generally speaking, in accordance with the invention, a halogen lamp assembly having a number of independently formed component parts is provided. The lamp assembly of the invention includes a base which rests on a table or desk surface and a power connector assembly selectively retained in part by the base. The power connector assembly includes a receptacle assembly mounted in the base for receiving an electrically conductive arm assembly and a wire assembly coupled to the receptacle assembly which may be plugged into a conventional electrical outlet. The lamp assembly further includes a bulb housing for retaining a conventional halogen bulb that is selectively connectable to the arm assembly at the other end thereof.

In operation, after the wire assembly is plugged into an electrical outlet, current may be conducted through the receptacle assembly and arm assembly (by turning on a switch) in order to light the halogen bulb.

The housing preferably also includes a reflector retained above the halogen bulb in order to direct the transmission of light from the bulb (i.e. towards the desk or surface to be illuminated). Further, the housing also should include a metal shade disposed over the reflector and bulb which helps prevent inadvertent access to the bulb when the overall lamp assembly is operational.

The assembly of the invention has the particular advantage that the various component parts may be constructed at different location and then be assembled by the manufacturer. In particular, the manufacturer will construct the lamp assembly by first coupling the power connector assembly to the insulating base. The manufacturer also construct the housing by snap fitting the reflector and shade onto and over the bulb housing. Therefore, after the purchaser buys the lamp assembly, he or she simply has to attach the arm assembly to the base and then to bulb housing.

Accordingly, it is an object of the invention to provide a new and improved halogen lamp assembly.

It is still another object of the invention to provide a halogen lamp assembly that includes a number of individually manufactured components.

Yet a further object of the invention is to provide a halogen lamp assembly which may be easily assembled and disassembled.

Yet another object of the invention is to provide a halogen lamp assembly which is inexpensive to manufacture.

Still other objects and advantages of the invention will in part be obvious and will in part be apparent from the following description.

The invention accordingly comprises the several steps and the relation of one or more of such steps with respect to each of the others, and the article possessing the features, properties and the relation of elements, which are exemplified in the following detailed disclosure, and the scope of the invention will be indicated in the claims.

BRIEF DESCRIPTION OF THE DRAWINGS

For a fuller understanding of the invention, reference is made to the following description taken in connection with the accompanying drawings, in which:

FIG. 7 is an exploded side elevational view showing the base, power connector assembly and one of the arms of the overall halogen lamp assembly;

FIG. 8 is an exploded view of the components in FIG. 7 shown in cross-section prior to construction of the overall halogen lamp assembly;

DETAILED DESCRIPTION OF THE PREFERRED EMBODIMENT

Figure 1:
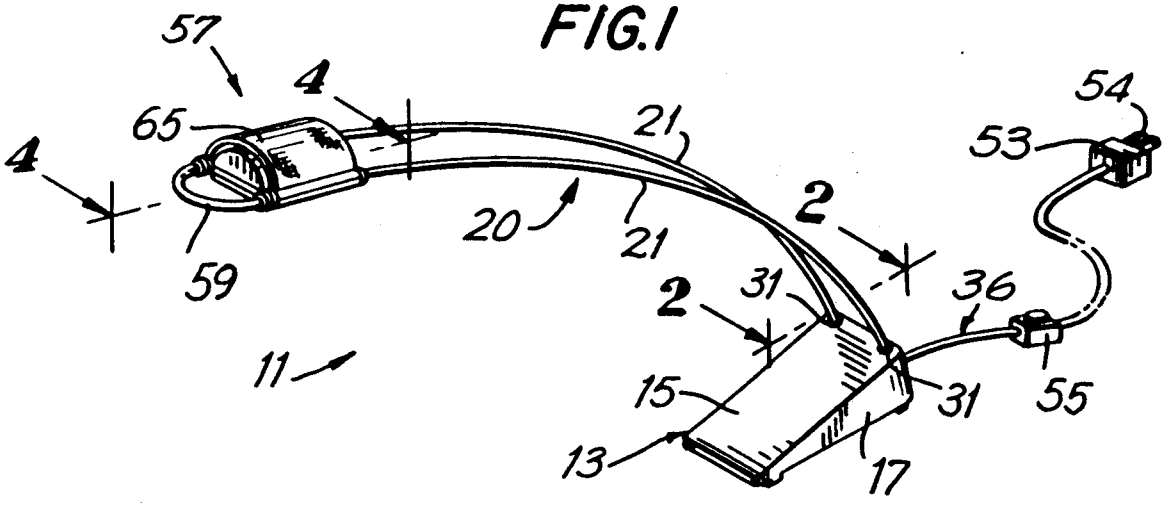
FIG. 1 is a perspective view of the halogen lamp assembly made in accordance with the invention.
Figure 3:
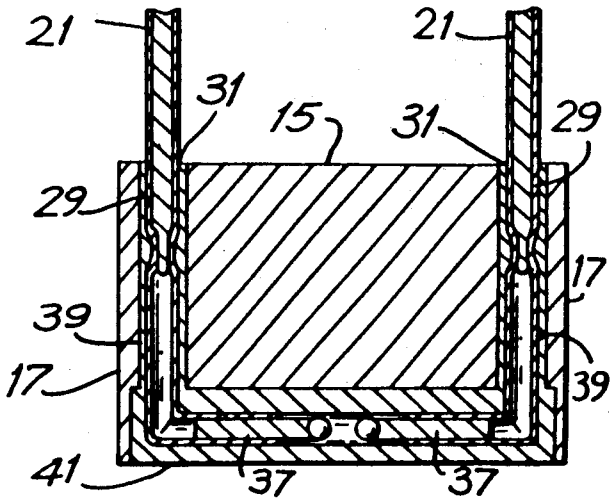
FIG. 3 is a cross-sectional view taken along line 3—3 of FIG. 2.
Figure 2:
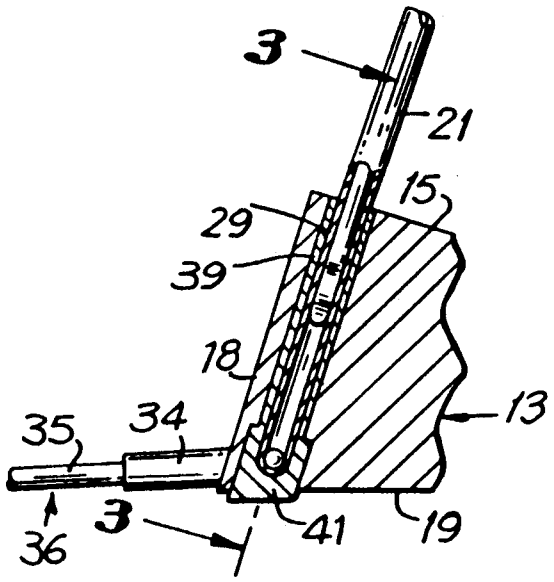
FIG. 2 is a cross-sectional view taken along line 2—2 of FIG. 1 and showing the power connector assembly retained in the base.

Referring first to FIG. 1, a halogen lamp assembly generally designated at 11 and made in accordance with the invention is shown. Lamp assembly 11 includes a wedged-shaped base 13 having a substantially triangular configuration in cross-section, an arm assembly 20 removably retained by base 13 and comprising a pair of bars 21 and a lamp head assembly also attached to arm assembly 20 at the forward end thereof. As best shown in FIGS. 1, 3 and 8, base 13 includes a top portion 15 formed with a pair of openings or holes 31 for receiving bars 21 (as described in more detail below), a pair of side portions 17, a bottom portion 19 and a rear portion 18 from which a wire assembly generally indicated at 36 extends. Base 13 is formed with a substantially "U" shaped chamber 50, as shown in FIG. 8, which communicates with holes 31 formed along top portion 15 of base 13 for receiving bars 21, as described in more detail below.

Referring now to FIGS. 2-3 and FIGS. 7-8, a power connector assembly generally indicated at 38 and made in accordance with the invention is now described. Power connector assembly 38 consists of a receptacle assembly generally indicated at 40 retained within chamber 50 of base 13 and wire assembly 36 mentioned above. Receptacle assembly 40 includes a molded socket generally indicated at 33 (see FIG. 8) and a pair of conductive metal inserts, 29 retained therein. Molded socket 33 is made from a plastic material and includes a base portion 41 and a pair of upwardly extending arms 39 each formed with a neck 42. Base portion 41 and arms 39 are substantially tubular in construction and define a passageway 43 extending therethrough. Passageway 43 receives therein each of conductive inserts 29 so that necks 47 of inserts 29 mate with necks 42 of socket 33, as shown in FIG. 3 (by injection molding socket 33 about inserts 29). In addition, a pair of wire elements 37 are retained within the leg portions of each of inserts 29 (see FIG. 3). Wire elements 37 contact the inner wall of conductive inserts 29 in order to form a current pathway therebetween.

As discussed briefly above, power connector assembly 38 also includes a wire assembly 36 extending from back portion 18 of base 13. Wire assembly 36 includes a strain relief member 34 from which projects a pair of wire members 35. Wire members 35 are connected at one end to wire elements 37 disposed within inserts 29 (not shown) and lead to low voltage alternating current transformer 53 (see FIG. 1) at their other end. Transformer 53 includes a pair of prongs 54 which may be inserted into a conventional electrical wall outlet. Wire members 35 are also coupled along the mid portion thereof to an operating switch 55 which may be turned to an on or off position depending upon whether or not the overall lamp assembly is to be operational. Thus, current may travel along wire members 35 to wire elements 37 and then along corresponding conductive inserts 29 disposed within passageway 43 of socket 33.

In order to assure total safety and to comply with all existing safety standards, a low voltage power supply is used, which in this case is transformer 53. The primary winding (not shown) of transformer 53 is connected to an electrical wall outlet (via prongs 54) while the secondary winding or output (typically about 12 volts) is supplied to wire members 35 (a conventional line cord).

Still referring to FIGS. 2–3 and 7–8, the attachment of bars 21 of arm assembly 20 to base 13 is now described. Each of bars 21 includes a metal rod 25 and a plastic insulative sheath 23 formed thereabout. Metal rod 25 of bar 21 is formed with a plug end 27 beyond where sheath 23 ends suitable for reception by each of holes 31 formed along the top portion of base 15. Plug 27 includes a pair of shaved areas 26 and is received within the top portion of conductive insert 29 such that neck 47 thereof engages shaved areas 26. If reception is correct, then bar 21 will not be able to rotate about its longitudinal axis due to the engagement of neck 47 of insert 29 with shaved areas 26 of plug 27. In addition, plugs 27 of bars 21 are retained in inserts 29 by means of a friction fit.

Further, since plug 27 contacts conductive insert 29 when bar 21 is coupled to base 13, an electrical pathway is formed between rods 25 of bar 21 and insert 29. As a result, when switch 55 of wire assembly 36 is turned on, current may be transferred along the electrical pathway formed within receptacle assembly 40 (now retained within housing 49 of base 13) to bars 21. As will be described below, the current transferred will be used to cause a halogen bulb retained within head assembly 57 to illuminate.

Figure 5:
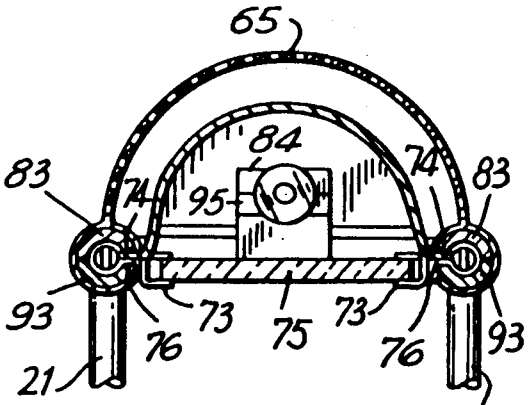
FIG. 5 is a cross-sectional view taken along line 5—5 of FIG. 4.
Figure 9:
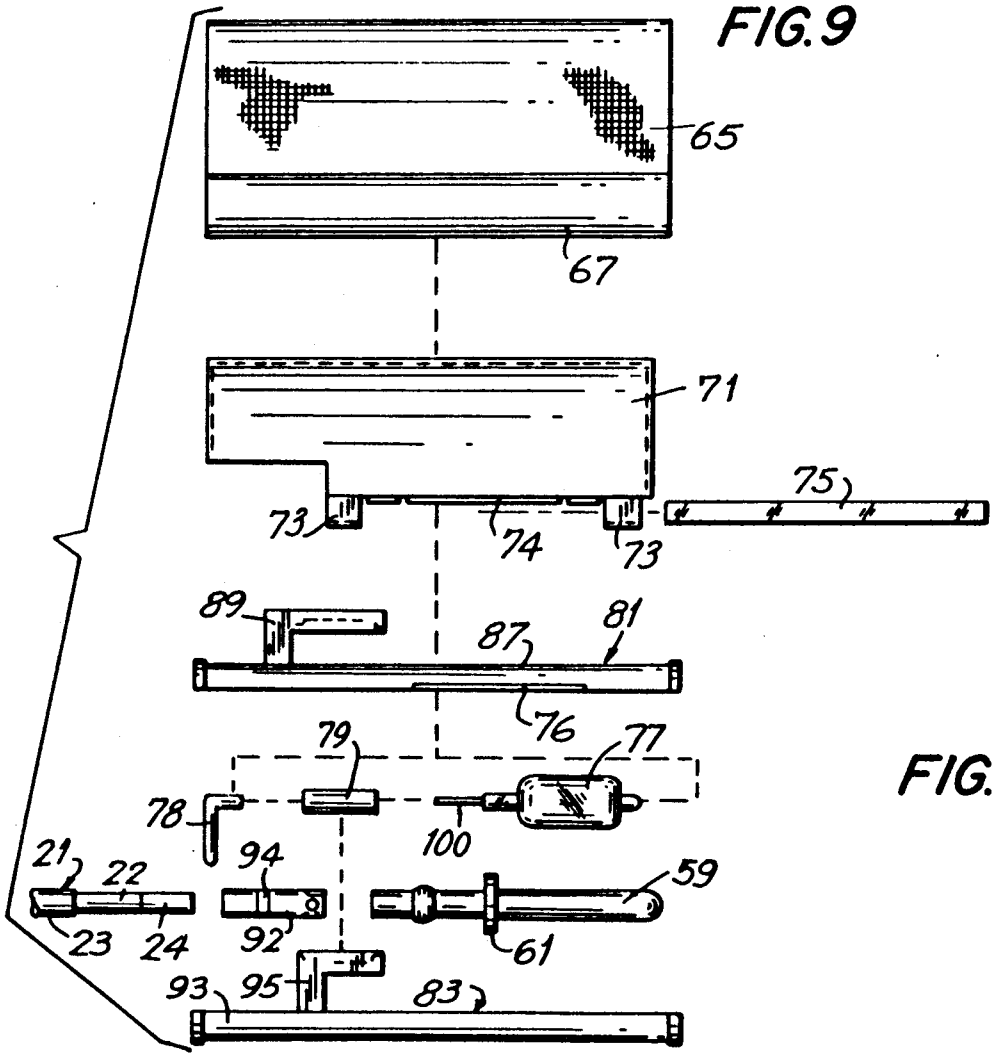
FIG. 9 is an exploded side view of the bulb housing assembly made in accordance with the invention.
Figure 10:
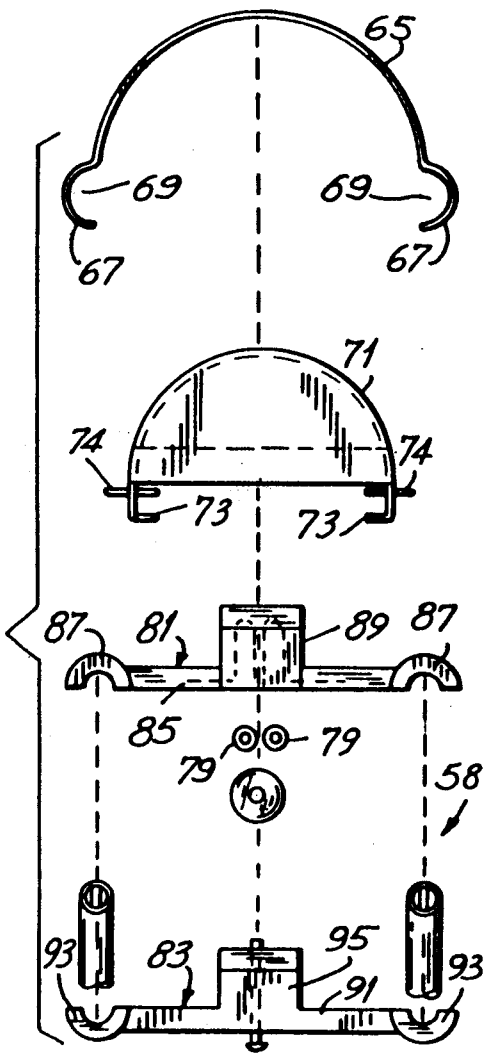
FIG. 10 is an exploded front elevational view of the components of the bulb housing assembly shown in FIG. 9.

Referring now to FIGS. 4–6 and 9–10, lamp head assembly 57 is now described. Lamp head assembly 57 includes a bulb housing generally indicated at 58, a reflector 71 mounted over bulb housing 58 and a shade or cover 65 mounted over reflector 71. Bulb housing 58 comprises an upper member 81 and a lower member 83 which in assembly faces and is coupled to upper member 81, as shown in FIG. 5. Upper member 81 includes a cross piece 85, a pair of arms 87 projecting forward from either end of cross piece 85 and having a semi-circular cross-section, and an upper wire casing element 89 projecting upwardly from substantially the mid area of cross piece 85. Similarly, lower member 83 includes a cross piece 91, a pair of arms 93 projecting forwardly from the ends of cross piece 91 and having a semi-circular cross-section and a lower wire casing element 95 projecting upwardly from the mid portion of cross piece 91. In assembly, upper member 81 and lower member 83 are positioned in face-to-face relationship, as best shown in FIG. 10, and adhered together along the inner surfaces thereof in order to construct bulb housing 58. When bulb housing 58 is constructed, arms 87 of upper member 81 and arms 93 of lower member 83 define a pair of tubular openings 98 (FIG. 6), which as described in more detail below receive the upper ends of bars 21.

Figure 4:
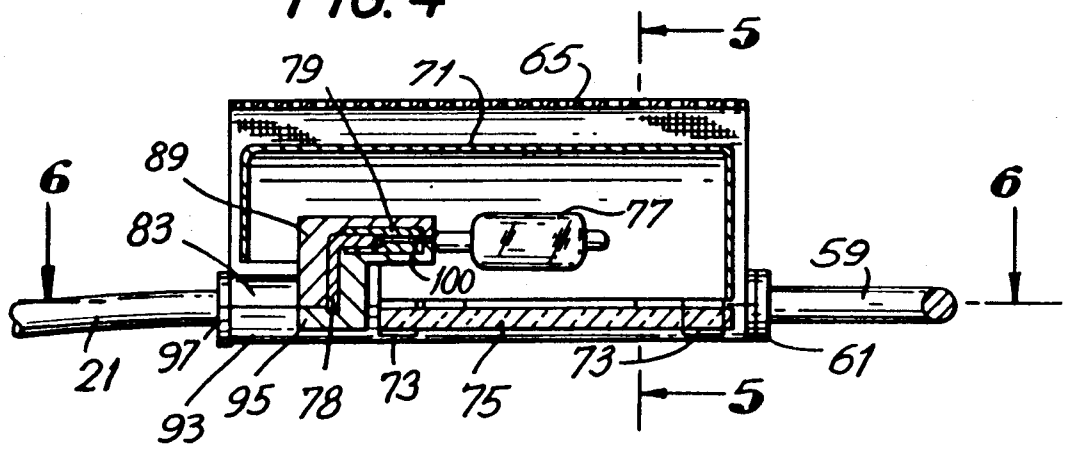
FIG. 4 is a cross-sectional view taken along line 4—4 of FIG. 1 and illustrating the housing assembly for retaining a halogen bulb.

Continuing with FIGS. 4–6 and 9–10, upper wire casing element 89 and lower wire casing element 95 define a passageway therethrough for retaining a pair of wire elements 78 therein. Wire elements 78 run to either side of housing 58 through cross pieces 85 and 91 (FIG. 6) and project into tubular openings 98 defined by arms 87 and 93. Wire elements 78, as shown in FIG. 4, lead to a pair of contacts 79 disposed forwardly within casing elements 89 and 95 and are suitable for receiving pins 100 projecting from the rear of a conventional halogen bulb 77. Halogen bulb 77 is mounted in bulb housing 38 forward of casing elements 89 and 95 (see FIG. 4) and within the space below reflector 71.

Figure 6:
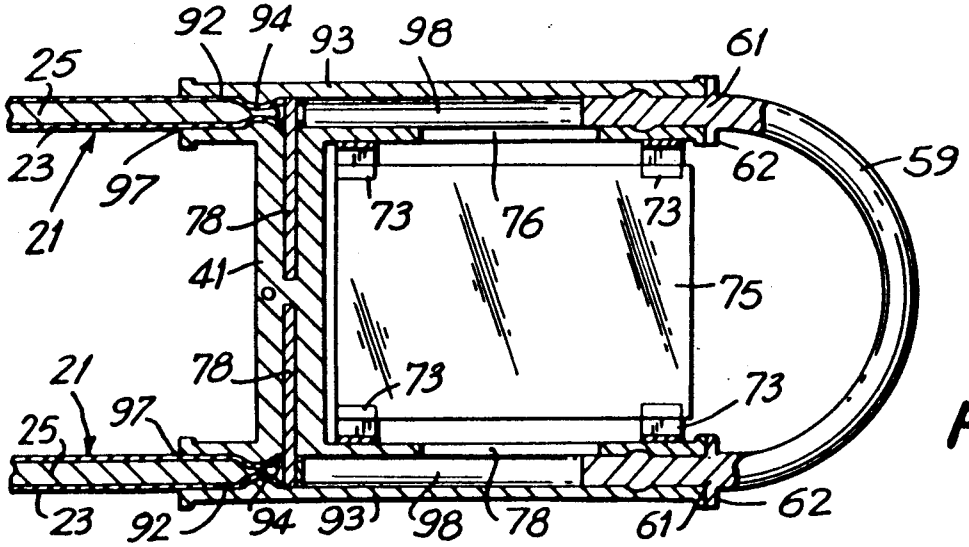
FIG. 6 is a cross-sectional view taken along line 6—6 of FIG. 4.

Referring now to FIG. 6, as well as to FIG. 4, the connection of bars 21 to housing 58 is now described. Bars 21 (which project upwardly from base 13 as previously described) are each formed at their forward ends with a plug 22 having a pair of shaved areas 24. Openings 98 of housing 58 define a corresponding pair of rearwardly disposed plug regions 97 which retain a corresponding set of receptacles 92 having a neck region 94. When each of plugs 22 of bars 21 are inserted into socket 97, shaved areas 24 engage neck region 94 of receptacle 92. If engagement is correct, bars 21 will not be able to rotate about their longitudinal axis with respect to housing 58. In addition, plugs 22 of bars 21 are retained in receptacles of housing 58 by means of a friction fit.

In addition, since each of plugs 22 contact conductive receptacles 92 when bar 21 is coupled to housing 58, a conductive pathway is provided from bars 21 to wire elements 78 (see FIG. 6) and ultimately to halogen bulb 77. Thus, when the lamp assembly of the invention is operational, current provided from a conventional wall outlet is run through wire assembly 36 and receptacle assembly 40 up through bars 21 of arm assembly 20 in order to provide the appropriate current required to cause bulb 77 to illuminate.

Referring now to FIGS. 4 and 5, as well as to FIGS. 9 and 10, the attachment of reflector 71 and shade or cover 65 to bulb housing 58 is now described. Reflector 71 is substantially arcuate in shape and includes an outwardly projecting lip 74 and a pair of inwardly projecting brackets 73, as shown in FIG. 10. In order to attach reflector 71 to bulb housing 58, reflector 71 is first positioned over housing 58 so that the lips 74 are each aligned with running inward slots 76 (FIG. 9) defined by arms 87 and 93 when upper member 81 and lower member 89 of housing 58 are attached. Reflector 71 is then compressed inwardly so that lips 74 may be inserted into slots 76, thereby attaching the reflector to housing 58 once inward compression is relieved.

Once attachment of reflector 71 is completed, a glass plate 75 may be mounted within housing 58 and below mounted halogen bulb 77. This is achieved by inserting glass plate 75 onto support brackets 73 projecting inwardly from reflector 71, as shown in FIGS. 5 and 9. Glass plate 75 prevents inadvertent access to bulb 77 (i.e. by a child) when the bulb is hot.

Continuing now with FIGS. 4–5 and 9–10, the attachment of shade or cover 65 to housing 58 is shown. Shade 65 is also substantially arcuate in a configuration and includes a pair of rounded arms 67 along either longitudinal edge thereof which define a running inwardly projecting curved slot 69. In order to attach shade 65 to housing 58, shade 65 is positioned forward of housing 58. Arms 67 are then slid over coupled arms 87 and 93 of upper member 81 and lower member 83.

Referring now to FIGS. 4, 6 and 9, a guard member 59 may be attached to housing 58. Guard member 59 is substantially semi-circular in configuration and includes a stop 61 at either end thereof, which lead into a pair of plugs 63. In order to attach guard member 59 to housing 58, plugs 63 are received within forward sockets 62 formed within the forward ends of side arms 87 and 93 when upper member 81 and lower member 83 of housing 58 are attached (the forward portions of tubular openings 98). As shown in FIG. 6, if insertion is proper, stops 61 are flush against the forward edges of attached arms 87 and 93. Guard 59 helps in preventing inadvertent contact with the head assembly and also helps create an aesthetically appealing product.

Although the lamp assembly of the invention is shown in the drawings as a table lamp, the lamp may also be constructed so as to rest on the floor or even be mounted on the wall without departing from the inventive concept.

The lamp assembly of the invention is advantageous since all the components may be constructed (molded) at a location away from where manufacturing takes place, with the manufacturer only having to assemble the various component parts together in the manner described hereinabove. The effect is that overall manufacturing costs will be reduced and large volume production may be achieved.

It will thus be seen that the objects set forth above, among those made apparent from the preceding description, are efficiently attained and, since certain changes may be made in carrying out the above method and in the articles set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A lamp assembly comprising:

a base;

a power connector assembly selectively retained at least in part by said base and connectable to an electrical current source;

an arm assembly having a first end and a second end and made from an electrically conductive material, said arm assembly selectively connectable to said base at said first end for conducting current from said power connector assembly through said arm assembly; and a bulb housing assembly for retaining a bulb, said housing assembly selectively connectable to said arm assembly at the second end thereof for selectively conducting current from said arm assembly to said bulb;

wherein said bulb housing includes a first upper member, a second lower member coupled to said upper member, and means for selectively retaining a bulb;

wherein said upper member includes a first cross element having first and second ends and a mid portion, a pair of arms projecting forwardly of said element from the ends thereof, and first upper means for housing said bulb retaining means; and wherein said lower member also includes a second cross element aligned with said first cross element having a first end and second ends and a mid portion, a pair of arms projecting forwardly of said second element from the ends thereof and aligned with said upper member arms and a second lower means for housing said bulb retaining means.

2. The lamp assembly of claim 1, wherein the power connector assembly comprises:

a receptacle assembly retained in said base for receiving the arm assembly; and a wire assembly electrically coupled to said receptacle assembly for selective connection to said electrical current source.

3. The lamp assembly of claim 2, wherein said base includes a chamber for retaining said receptacle assembly, and wherein said receptacle assembly includes a socket member retained within said chamber and a pair of conductive inserts retained within said socket member.

4. The assembly of claim 3, wherein said arm assembly comprises a pair of bar members and wherein said conductive inserts receive said bar members when said arm assembly is selectively connected to said base.

5. The lamp assembly of claim 4, wherein said wire assembly includes a wire element extending from said base and electrically connected to said conductive inserts, means for coupling said wire element to said electrical current source and means for selectively causing current to flow from said current source through said wire element.

6. The assembly of claim 1, wherein said cross elements retain therebetween wire elements electrically coupled to said upper and lower bulb retaining means.

7. The assembly of claim 6, wherein each of said pairs of aligned arms of said upper and lower members define a pair of tubular openings each having a first forward end and a second rearward end.

8. The assembly of claim 7, wherein said rear ends of said tubular openings formed in said arms selectively receive said bar members of said arm assembly.

9. The assembly of claim 7, further including a guard element projecting forward from said housing assembly.

10. The assembly of claim 9, wherein said guard element includes a first plug member and a second plug member for selective reception within the forward ends of said tubular openings.

11. The assembly of claim 1, wherein said lamp assembly further includes a reflector element selectively mountable on said housing assembly and over said bulb.

12. The assembly of claim 11, wherein said arms of said upper member are each formed with an inwardly running slot and wherein said reflector includes a pair of oppositely disposed outwardly extending tongues for reception in said slots of said upper member arms when mounting said reflector on said housing assembly.

13. The assembly of claim 12, wherein said reflector includes at least one pair of inwardly projecting support brackets for supporting a glass plate below said bulb when said reflector is mounted on said housing assembly.

14. The assembly of claim 11, further including a cover element selectively coupled to said housing assembly and over said reflector element.

15. The assembly of claim 14, wherein said cover element is slidably mounted over said reflector element.

16. A lamp assembly comprising:

a power connector assembly selectively connectable to an electrical current source, said connector assembly including a receptacle assembly and a wire assembly electrically coupled to said receptacle assembly;

a base having an opening for selectively retaining said receptacle assembly;

an arm assembly having a first end and a second end, said arm assembly selectively connectable to said receptacle assembly at said first end thereof when said receptacle assembly is retained in said base; and a bulb housing assembly for retaining a bulb selectively connectable to said arm assembly at the second end thereof;

wherein said bulb housing includes a first upper member, a second lower member coupled to said upper member, and means for selectively retaining a bulb.

wherein said upper member includes a first cross element having first and second ends and a mid portion, a pair of arms projecting forwardly of said element from the ends thereof, and first upper means for housing said bulb retaining means; and wherein said lower member also includes a second cross element aligned with said first cross element having a first end and second ends and a mid portion, a pair of arms projecting forwardly of said second element from the ends thereof and aligned with said upper member arms and a second lower means for housing said bulb retaining means.

* * * * *